US006715689B1

(12) United States Patent
Lee et al.

(10) Patent No.: US 6,715,689 B1
(45) Date of Patent: Apr. 6, 2004

(54) INTELLIGENT AIR-CONDITION SYSTEM

(75) Inventors: Tzong-Sheng Lee, Miao-Li (TW); Kuo-Hua Tseng, I-Lan (TW); Long-Der Chen, Hsin-Chu (TW); Jimmy Yu, Taipei (TW)

(73) Assignee: Industrial Technology Research Institute, Hsin-Chu (TW)

( * ) Notice: Subject to any disclaimer, the term of this patent is extended or adjusted under 35 U.S.C. 154(b) by 0 days.

(21) Appl. No.: 10/410,290

(22) Filed: Apr. 10, 2003

(51) Int. Cl.[7] ..... F24F 7/00
(52) U.S. Cl. ..... 236/49.3; 236/51
(58) Field of Search ..... 236/49.3, 91 C, 236/91 E, 51; 62/186, 208, 209, 180

(56) References Cited

U.S. PATENT DOCUMENTS 4,724,329 A * 2/1988 Doyle et al. ..... 250/504 R
5,187,943 A * 2/1993 Taniguchi et al. ..... 62/180
5,221,919 A * 6/1993 Hermans ..... 340/567
5,303,525 A * 4/1994 Magee ..... 52/306
5,703,367 A * 12/1997 Hashimoto et al. ..... 250/342
5,857,906 A * 1/1999 Cho ..... 454/229
6,137,407 A * 10/2000 Akagawa et al. ..... 340/552
6,202,934 B1 * 3/2001 Kamiya et al. ..... 236/91 C
6,262,418 B1 * 7/2001 Hashimoto et al. ..... 250/338.3
6,264,331 B1 * 7/2001 Sawai et al. ..... 353/31

FOREIGN PATENT DOCUMENTS

JP 359035746 A * 2/1984
JP 402197747 A * 8/1990
JP 405223319 A * 8/1993
JP 08122156 A * 5/1996

* cited by examiner

*Primary Examiner*—William E. Tapoloai
*Assistant Examiner*—Mohammad M. Ali
(74) *Attorney, Agent, or Firm*—Birch, Stewart, Kolasch & Birch, LLP

(57) ABSTRACT

An intelligent air-condition system that detects the signals of the temperature distribution among the environment by using the infrared radiation, especially detects the location of the human-body temperature signals. Hence, according to the detected signals, the gas(es) for air-conditions can be firstly transmitted into the location where the human-body temperature signals exist, or be firstly transmitted into where the local temperature is urgent to be adjusted. Besides, the transitions of the gas(es) can be paused or stopped while there is no human-body temperature.

19 Claims, 8 Drawing Sheets

INTELLIGENT AIR-CONDITION SYSTEM

The present invention will become more fully understood from the detailed description given hereinbelow and the accompanying drawings which are given by way of illustration only, and thus are not limitative of the present invention, and wherein:

BACKGROUND OF THE INVENTION

1.Field of the Invention

The present invention is concerned with an intelligent air-condition system. Moreover, it is specifically related to a system that decides the temperature distribution among the ambient environment by analyzing received infrared radiation and directly delivers the gas to where the human-body temperature signal(s) located.

2. Description of the Prior Art

A variety of air-condition systems are broadly applied in the contemporary life, such as refrigerator and fan. Therefore, accompanying with the rapid development of the contemporary technology, how to further improve the current air-condition systems still is a hot filed. Herein, for example, possible issues of the hot filed has at least how to the efficiency of producing the gas used by the air-condition system, how to reduce the pollution of the air-condition systems, and how to increase the operating convenience of the air-condition systems.

For the conventional air-condition systems, after the required gas is formed, the gas is usually delivered to the ambient environment by the following three ways: (1) The gas is periodically delivered among a large angle such that the gas is uniformly distributed over the ambient environment. (2) The gas is delivered in fixed direction such that the gas is distributed over the ambient environment by the sequentially diffusion of the gas. (3) The gas is delivered into a specific portion of the ambient environment while the gas-direction controlling device is directly adjusted by the user. Besides, the delivery of the gas sometime is automatically adjusted in accordance with the rules predetermined by the user or whether the temperature of the ambient environment is located in a predetermined range.

However, all of the conventional ways have a common disadvantage: the gas is delivered by a determined way. Hence, the delivery of the gas cannot be adjusted in time in accordance with the immediate states of the users, such as the existence of the users, the number of the users and the location of each user. As shown in FIG. 1A, the gas 11 is repeatedly delivered by the air-condition system 12 among a large angle and a portion of the ambient environment 10. Hence, the user 13 only can immediately feel the effect of the gas 10 while the moment the gas 11 is directly delivered through the location of the user 13. Otherwise, the user 13 only can indirectly feel the effect of the gas 10 while the gas 13 is diffused from the objects 14 or other portion of the ambient environment 10 to the location of the user 13. As shown in FIG. 1B FIG. 1C, and FIG. 1D, the gas is continually delivered by the air-condition system 12 to a specific portion of the ambient environment 10. Clearly, the user 13 can be immediately affected, even improperly affected, by the gas 10 while the user 13 is exactly located in the specific portions. However, the user always does not immediately affected by the gas 10 while the user is not located in the specific portions (for example, the user 13 walks in and walk out the specific portion). Herein, as shown in FIG. 1E, the air-condition system 12 has usually analyzing and controlling means 121 fir controlling the operation of the air-condition system 12, gas means 122 for producing the gas used by the air-condition system 12 and power means 123 for providing the power used by the gas means 122.

Significantly, the conventional air-condition system can not directly affect the user, but must treat both the location of the user and the ambient environment at the same time. Hence, some disadvantages are unavoidable for the conventional air-condition system, such as the user need a long period to feel the effect of the air-condition system, the consumed power of the air-condition system is large and the convenience of the air-condition system is limited. Therefore, how to improve the previous disadvantages become an important and a valuable topic.

SUMMARY OF THE INVENTION

One main purpose of the present invention is to provide an intelligent air-condition system that directly affects the user by elastic operation.

Another main purpose of the present invention is to provide an intelligent air-condition system that directly deliver the gas to the detected immediate location of the user.

The other purpose of the present invention is to provide an intelligent air-condition system that improves some unavoidable disadvantages of the conventional air-condition systems by detecting the infrared radiation and by elastically delivering the gas.

The present intelligent air-condition system essentially detects the signals of the temperature distribution among the ambient environment by using the infrared radiation, especially by detecting the location of the human-body temperature signals. Surely, it also could particularly detect any predetermined sign(s), such as the infrared radiation signals radiated by the computer host in a computer room. Hence, according to the detected signals, the gas(es) used air-conditions can be firstly transmitted into the location where the human-body temperature signals exist, or be firstly transmitted into where the local temperature is urgent to be adjusted.

To compare with the conventional air-condition system, the invention has at least the following advantages:

(1) Use the infrared radiation technology to handle the temperature distribution among the ambient environment, especially to handle the location of the human-body temperature (the user).

Hence, the invention does not need to deliver the gas to the ambient environment in according to a predetermined rule. In contrast, the invention can deliver the gas in according to the detected infrared radiation. For example, directly deliver the gas to the location of the user.

(2) The infrared radiation technology is a well-known technology, and commercial products are available and cheap.

Therefore, the invention can provide the information required for intelligent operation without increasing obviously cost.

(3) It is well known about how to control the device for changing the delivered direction of the gas. For example, the delivered direction can be changed by rotating the fan of moving the guiding plates of the refrigerator.

Therefore, while the invention uses a controlling means (such as microprocessor and memory) and determines some operating rules (herein, a FLASH could be used to recorded the new rules inputted by the user), it is trivial to elastically adjust or optimize how the gas is delivered in according to the detected infrared radiation information.

(4) The response time of the infrared radiation technology is very short. In fact, it almost can handle immediately the newest temperature distribution. Besides, for conventional air-conditions, the response time for changing the delivered direction of the gas also is very short.

Therefore, when the user is not fixed in a specific location but is moved among a range, the invention can deliver immediately the gas the newest location of the user. In other words, the invention provides an immediate air-condition to the user even the user is continually moving.

(5) The invention directly delivers the gas to the location of the user. In other words, the invention need not to adjust the temperature of the whole ambient environment to ensure the user is affected by the delivered gas.

Therefore, from the gas is delivered to the user is significantly affected by the gas, the invention only need to treat the location of the user but need not to treat the whole ambient environment. Indisputably, the invention can reduce the required cost, reduce the side effect of pollution and prolong the lifetime of the present intelligent air-conditions system.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Some embodiments of the invention are described below. However, except the present details, the invention can also be applied in other embodiments. Hence, the scope of the invention is not limited by the following embodiments, but is decided by the present claims.

Initially, the inventors of the invention emphasize the conventional air-condition systems are limited by an important limitation: the temperature distribution among the ambient environment cannot be immediately handled. Thus, the delivery of the gas only is decided by the predetermined rules but cannot be adjusted immediately in according to the detected temperature distribution. And then, the gas is delivered in a fixed direction, or delivered periodically among an angle. Surely, the delivery of the gas could be also adjusted while the air-condition system is adjusted by the hands of the user.

Regarding to the important limitation, the inventors of the invention particularly emphasize the fact that the air-condition system only need handle the temperature distribution among the ambient environment but need not the clearly identify the scope of each object in the ambient environment. Therefore, because the popularly commercial infrared radiation sensor is capable of detecting effectively the distribution of different thermal signals among the ambient environment (for example, the infrared radiation sensor used to turn on a light while an passenger is appeared), the inventors provides a solution: integrate the infrared radiation sensor into the air-condition system to provide the ability of handling the temperature distribution among the ambient environment. Therefore, by using electronic devices, such as microprocessor, to analysis detected signals and to control the delivery of the gas, it is available to adjust immediately the delivery of the gas in accordance with the newest temperature distribution among the ambient environment (for example, the gas is delivered only the direction that the local temperature is most urgent to be adjusted).

Particularly, the infrared radiation sensor can detect the temperature distribution and can further detect the distributions of different sources with different individual temperature. Therefore, the invention can handle effectively the location of the user (with the infrared radiation of about 37.5° C.), and then can directly deliver the gas to the newest position of the user. Significantly, the invention provides a direct air-condition that the user feel immediately the air-condition effect, but the conventional air-condition systems provide an indirect air-condition that the user feel the air-condition effect while the whole ambient environment is affected. Herein, the inventors emphasize that the frequency of the infrared radiation is dependent on the temperature of the source and the heat of the source is proportional to the quantity of the emitted infrared radiation.

Figure 1A:
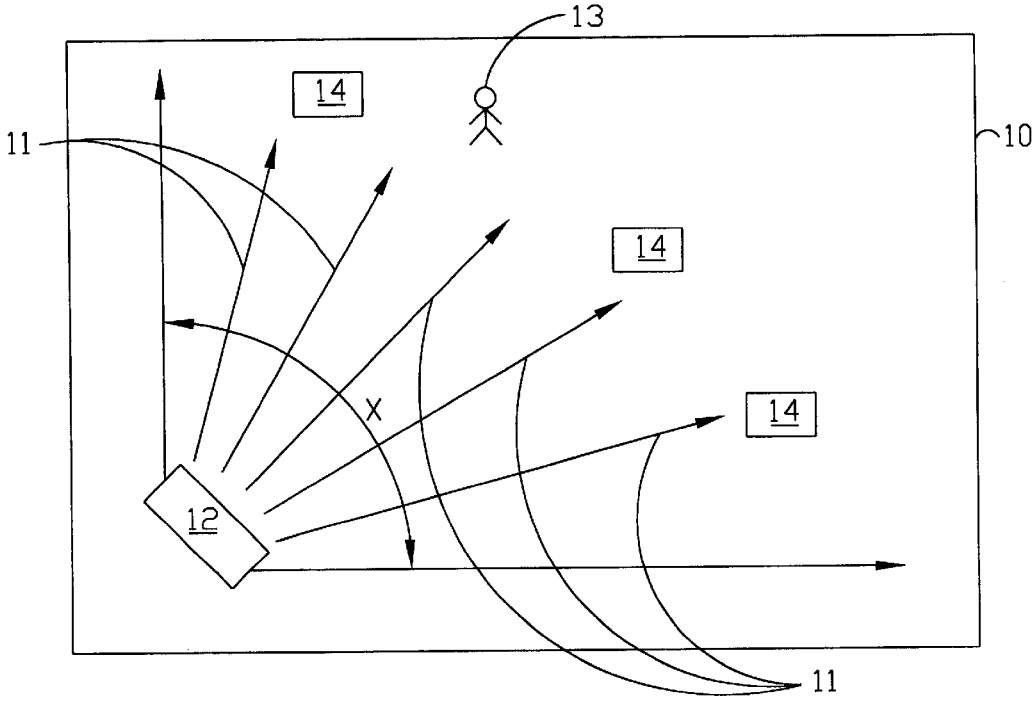
FIG.1A(Prior Art)
FIG. 1A to FIG. 1E show four operating model and the basic, components of the conventional air-condition system.
Figure 1B:
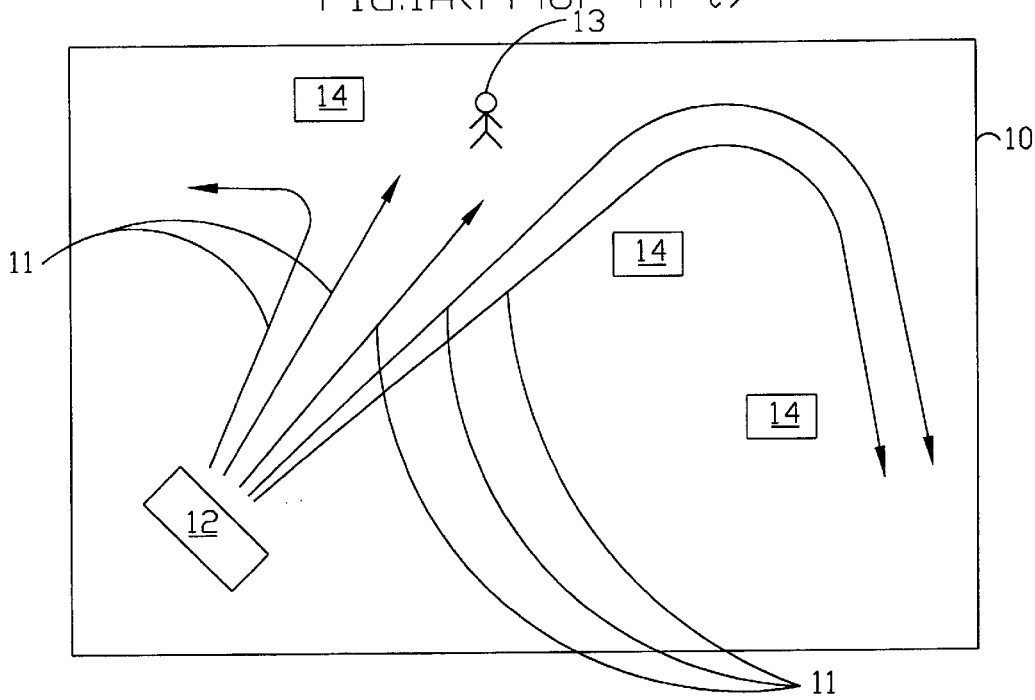
FIG.1B(Prior Art)
Figure 1C:
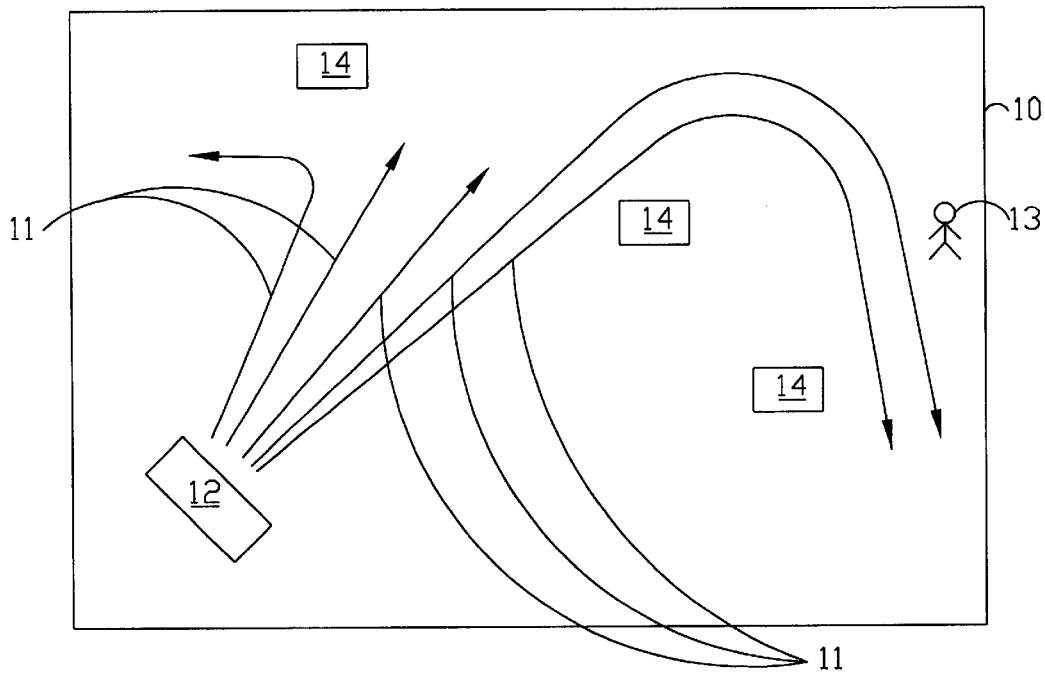
FIG.1C(Prior Art)
Figure 1D:
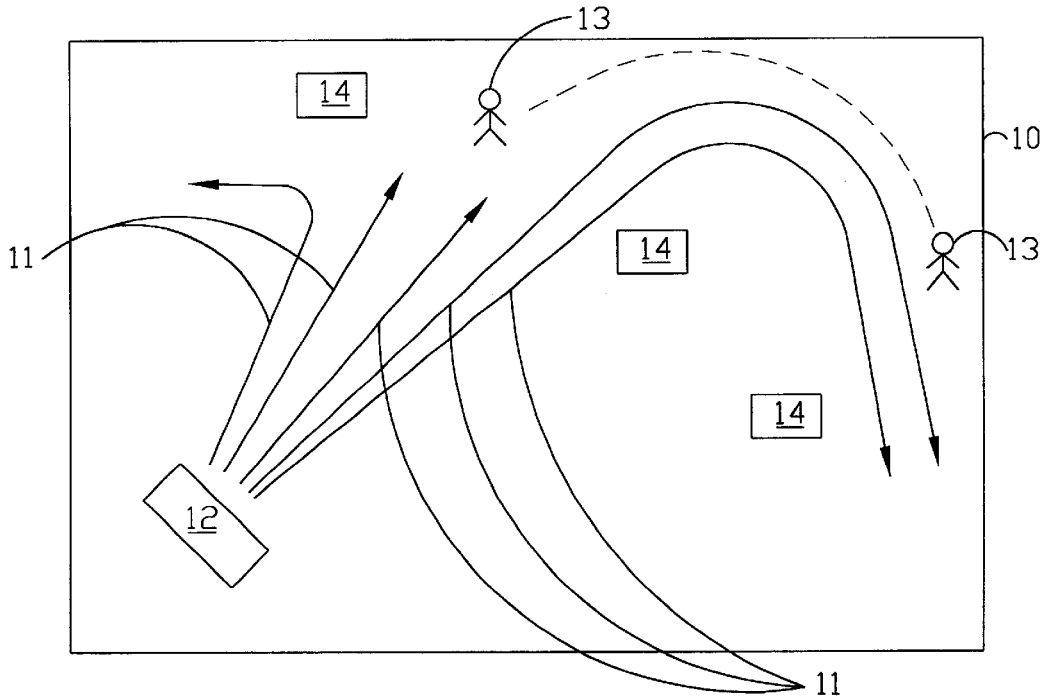
FIG.1D(Prior Art)
Figure 1E:
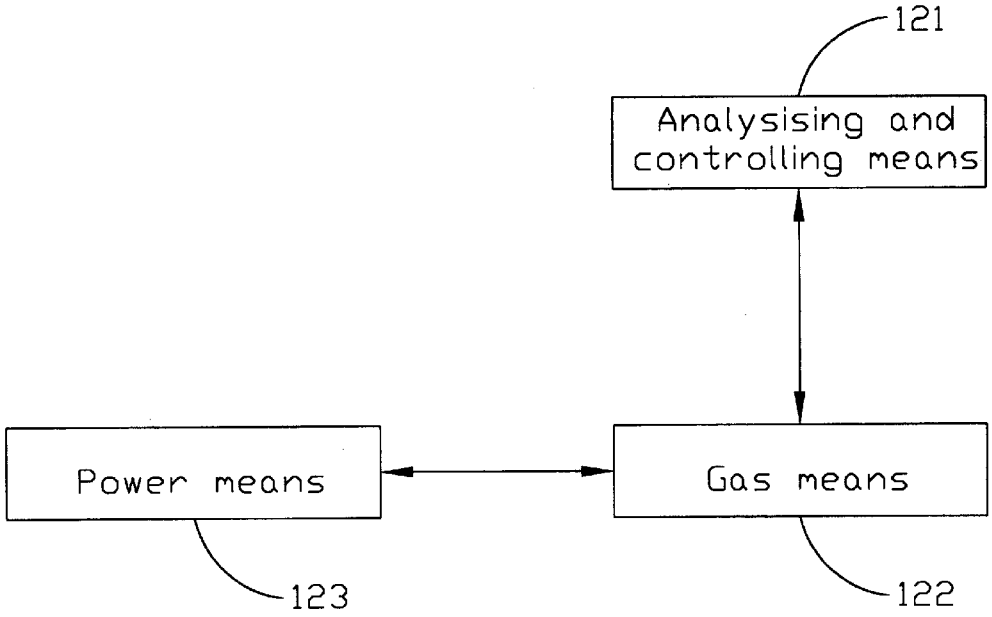
FIG.1E(Prior Art)
Figure 2A:
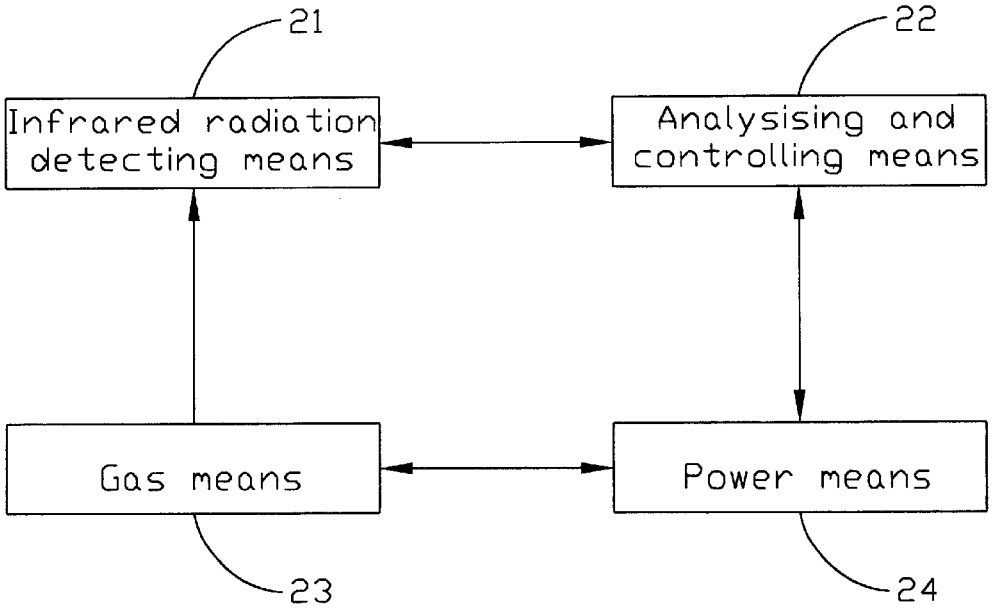
FIG. 2A to FIG. 2F show the basic components, the basic structure of each basic component and some available variations of the present intelligent air-condition system.

According to the previous discussions, the invention present an intelligent air-condition system. As shown in FIG. 2A, the intelligent air-condition system includes an infrared radiation detecting means 21, an analyzing and controlling means 22, a gas means 23 and a power means 24. Herein, note that the intelligent air-condition system can be fan, a refrigerator or any kind of air-condition system. Herein, the present invention uses detecting means 21, and analyzing and controlling means 22 to provide the "intelligent function" but does not amend the gas means 23, and then the present invention can be applied in any kind of air-condition system.

Infrared radiation detecting means 21 is used to detect a temperature distribution of an ambient environment. Herein, the scanning angle of the infrared radiation detecting means is between zero-degree to 360-degree. Analyzing and controlling means 22 is used to analysis the data acquired by infrared radiation detecting means 21 and producing a plurality of controlling signals for adjusting the temperature of the ambient environment. Gas means 23 is used to deliver a gas into the ambient environment by a specific way to change the temperature distribution in accordance with the controlling signals. Moreover, power means 24 is used to provide the power required by the operation of gas means 23.

Figure 2B:
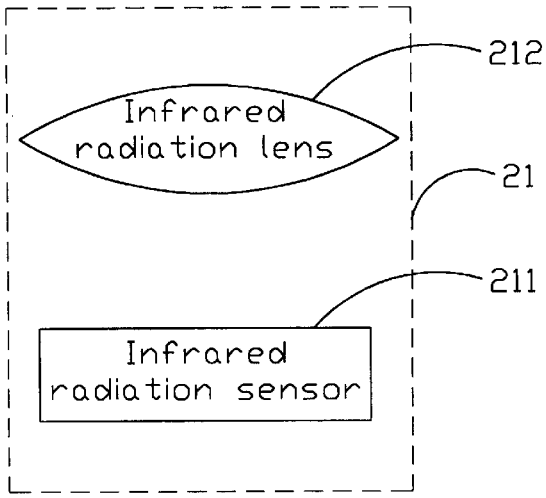

In general, as shown in FIG. 2B, infrared radiation detecting means 21 has at least an infrared radiation sensor 211 and an infrared radiation lens 212. Herein, infrared radiation lens 212 is used to focus the infrared radiation from the ambient environment, and infrared radiation sensor 211 is used to accept and detect the infrared radiation. For example, the available kinds of infrared radiation sensor 211 comprises an infrared radiation point sensor, an infrared radiation array sensor, or infrared radiation sphere sensor. For example, the available kinds of infrared radiation lens 212 comprises spherical lens array or semi-circle-cylinder lens array.

Figure 2C:
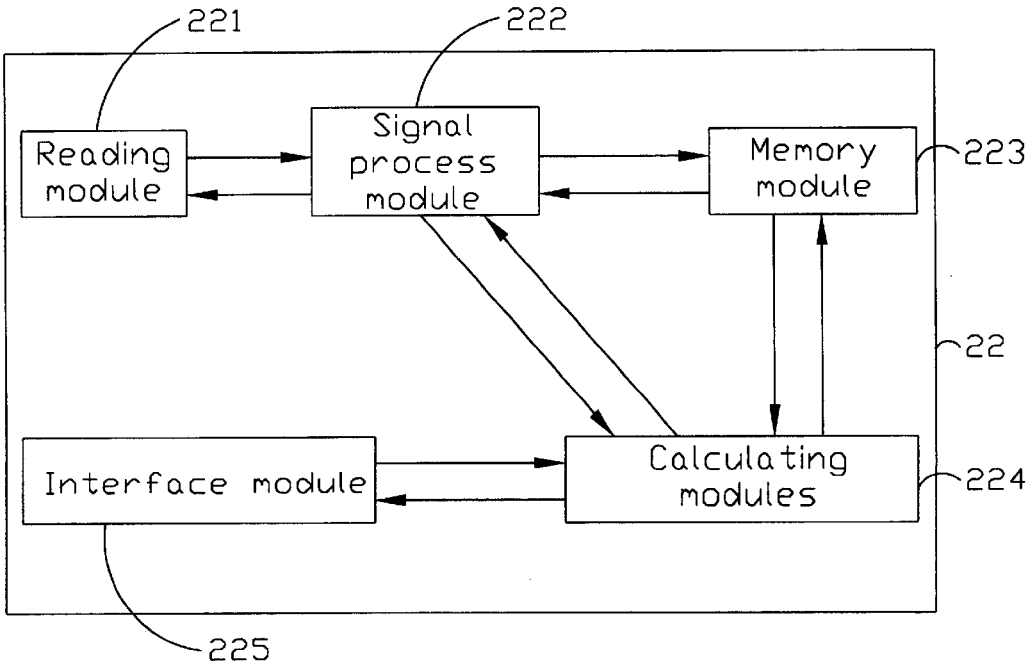

In general, as shown in FIG. 2C, an analyzing and controlling means 22 has a reading module 221, a signal process module 222, a memory module 223 and a calculating module 224. Reading module 221 is used to receive and accept the data that is detected by the infrared radiation detecting means 21; the signal process module 222 is used to process numerous signals that are produced by the operation of reading module 221; and memory modules 223 and calculating module 224 are used to produce the numerous controlling signals in according to the signals. Herein, the controlling signals are related to how to adjust the temperature of the ambient environment. Further, analyzing and controlling means 22 further has an interface module 225 which is used to receive at least one commend (for example, via the wireless radiation) and transmit the commends to calculating module 224.

Figure 2D:
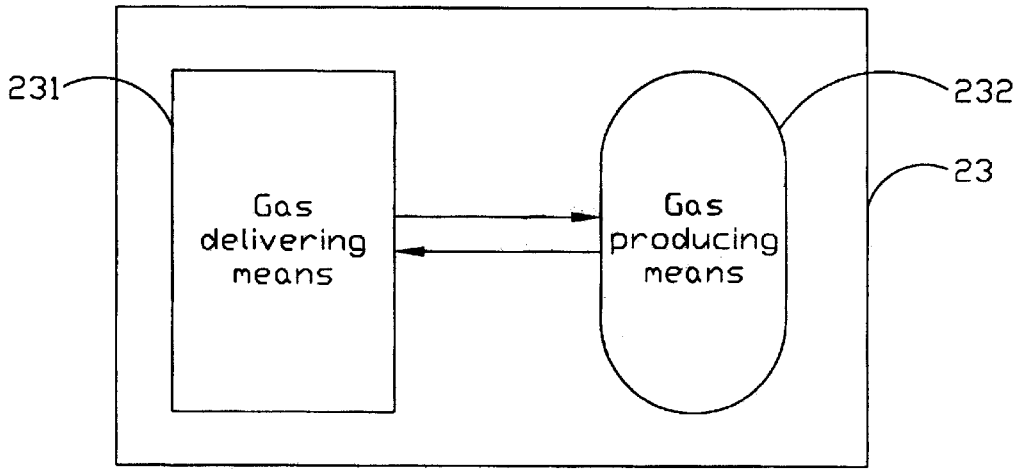

In general, as shown in FIG. 2D, the gas means 23 has a gas delivering means 231 for adjusting the delivered direction of the gas. Gas means 23 further has a gas producing means 232 for producing the gas while the gas is not a room temperature gas but is a cool gas or a warm gas. Herein, the gas could be cool gas, warm gas or room temperature gas, has delivering means 231 can be fan, a guiding plates or other devices. The gas producing means 232 can be a compressor, a heating coil, refrigerants or other device. Of course, if the present invention is applied in the electric fan or guiding plate, the gas producing means 232 is undesirable. In the case, the gas used by the intelligent air-condition system is the gas-flow induced by the fan (the gas delivering means 231).

Figure 2E:
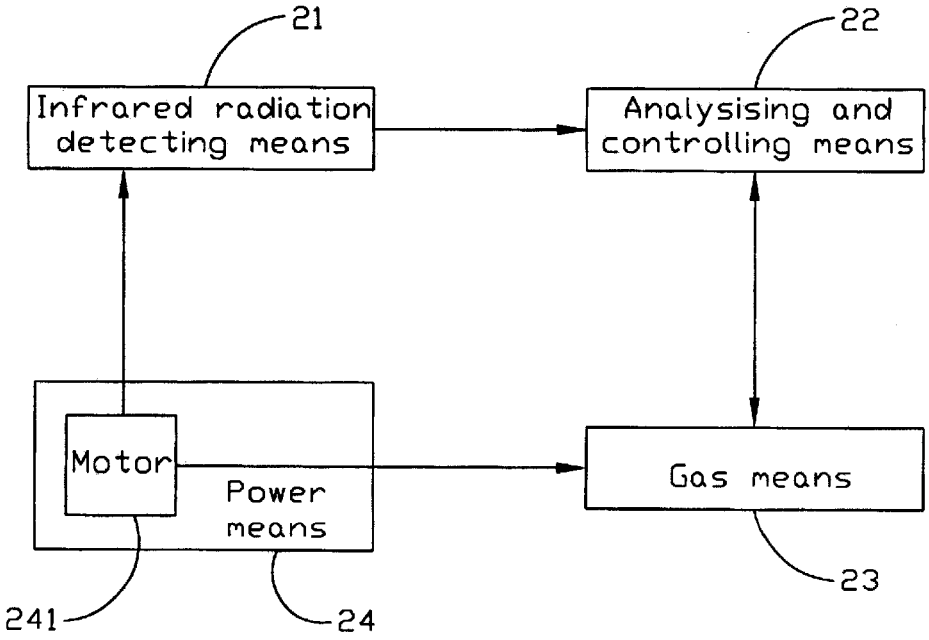
Figure 2F:
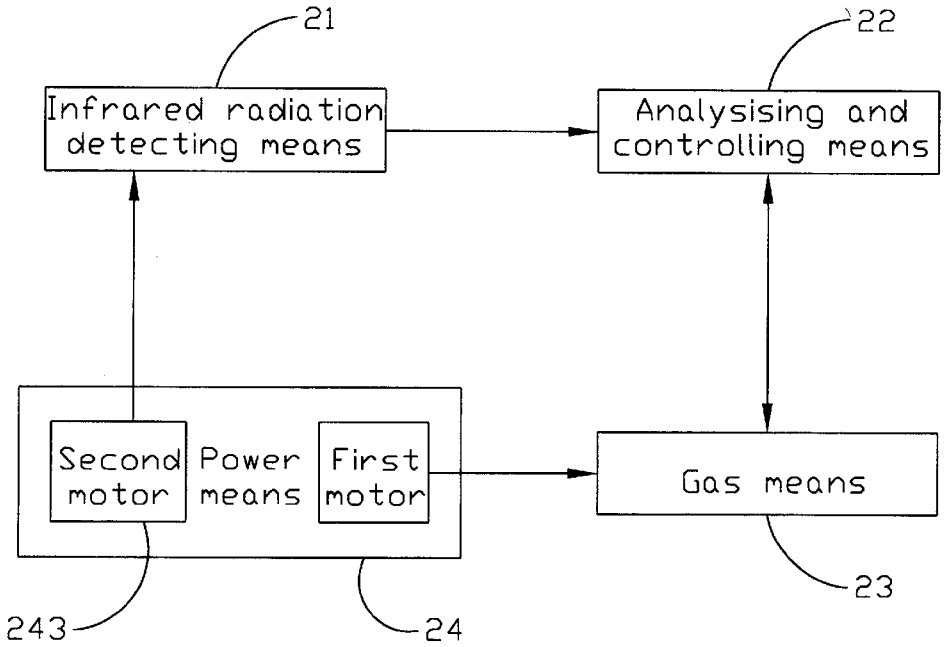

In general, as shown in FIG. 2E, the power means 24 has motor 241 for driving simultaneously gas means 23 and infrared radiation detecting means 21. Surely, infrared radiation detecting means 21 could be drove by battery but not by motor 241. Of course, as shown in FIG. 5E, power means 24 could also is a combination of the first motor 242 for driving gas means 23 and second motor 243 for driving infrared radiation detecting means 21. Moreover, because one-motor power means 24 has lower cost and higher design difficulty and two-motor power means 24 has higher cost and easier design difficulty, there is no reason to say which is better for power means 24. In fact, the details of power means 24 is decided by the requirement of each individual intelligent air-condition system.

Furthermore, the controlling signals are used to decide how the gas is produced and delivered. The operation of both gas means 23 and power means 24 is significantly affected by controlling signals.

In the present invention, the controlling signals can provide some optional operation modes. Herein, at least one of the operation modes can be used by the present intelligent air-condition system. Herein, the available operation modes are described as the following:

(a) The gas is directly delivered by gas means 23 into a portion of the ambient environment, wherein at least one human-body temperature signal detected by infrared radiation detecting means 21 is located at the portion. In other words, the intelligent air-condition system can provide a direct air-condition that the gas is directly delivered to where the user is.

(b) The gas is directly delivered by gas means 23 into a portion of the ambient environment. Herein, at least one specific temperature signal detected by infrared radiation detecting means 21 is located at the portion, and the predetermined temperature signal is predetermined or determined by the user such that some specific objects are urgently processed by the gas than the user.

(c) The operation of gas means 23 is paused or stopped while no human-body temperature signal located in the ambient environment is detected by infrared radiation detecting means 21. Hence, the quantity of consumed power used to treat the ambient environment without any user is saved. Of course, once the human-body temperature signal is appeared again in the ambient environment, the gas means 23 is turned on automatically (for example, to directly deliver the gas to the user again).

(d) The gas is continually delivered to the location (the newest location) of at least one human-temperature signal in time (or immediately) while the human-temperature signals detected by said infrared radiation detecting means are in motion. In other words, even the user walks among several areas, the present intelligent air-condition systems still provides the user with the direct air-condition.

Figure 3A:
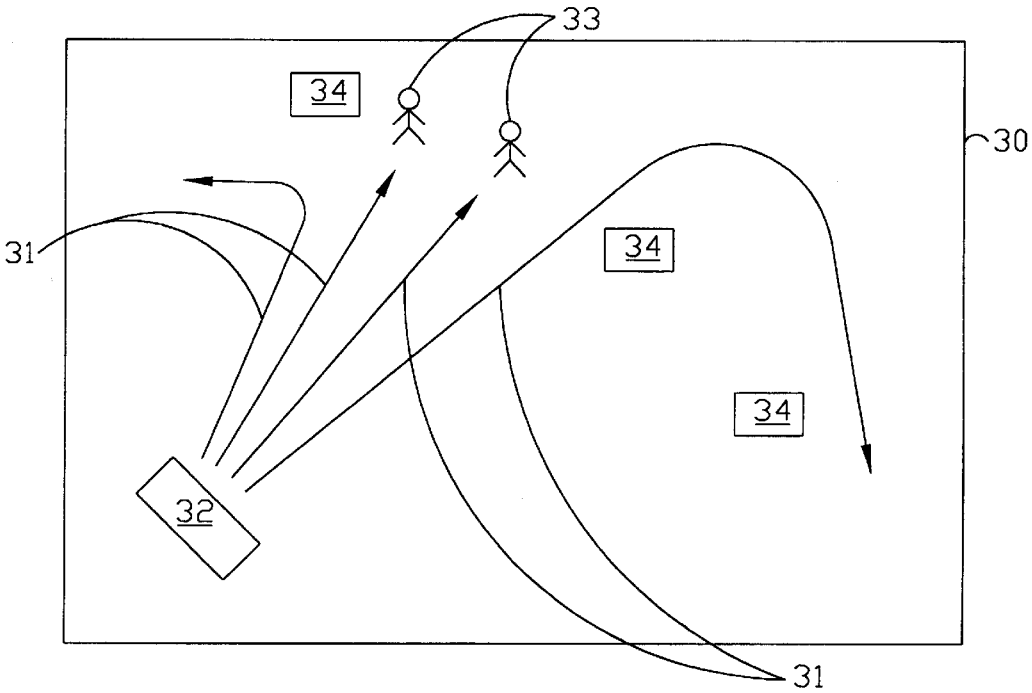
FIG. 3A to FIG. 3D show some characters of the operation of the present intelligent air-condition system.
Figure 3B:
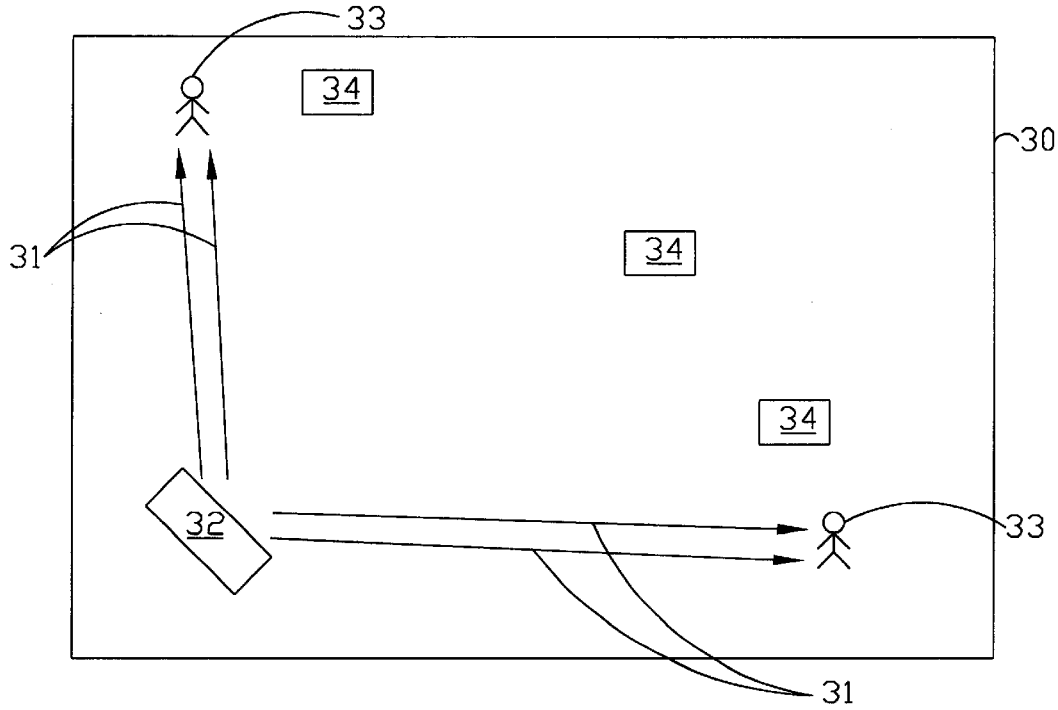
Figure 3C:
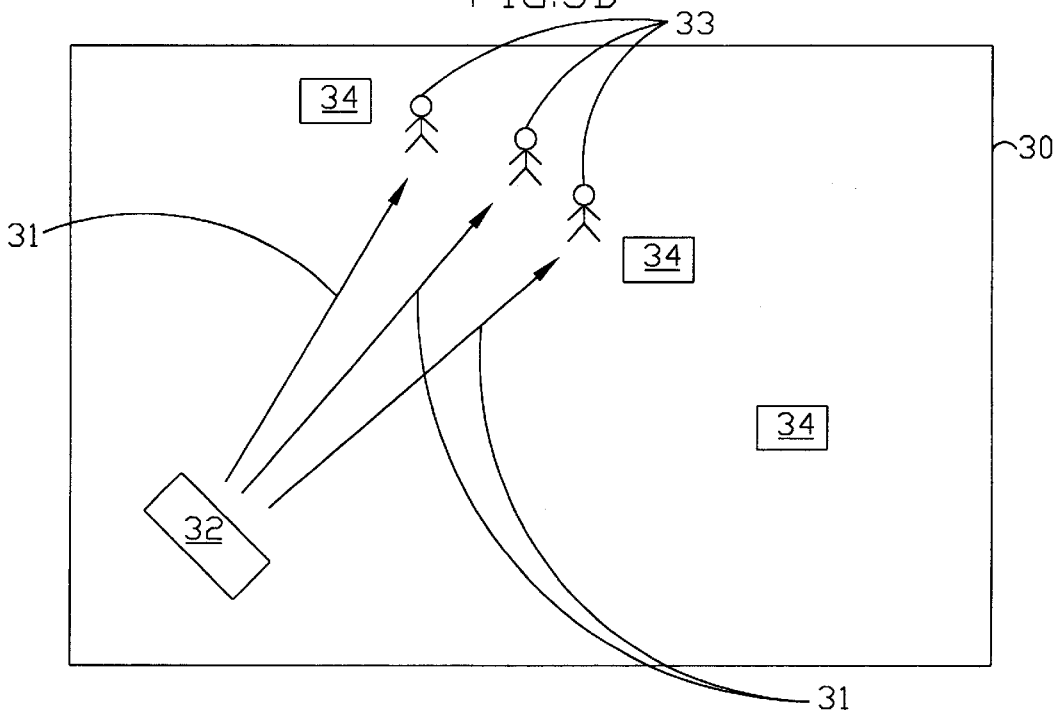
Figure 3D:
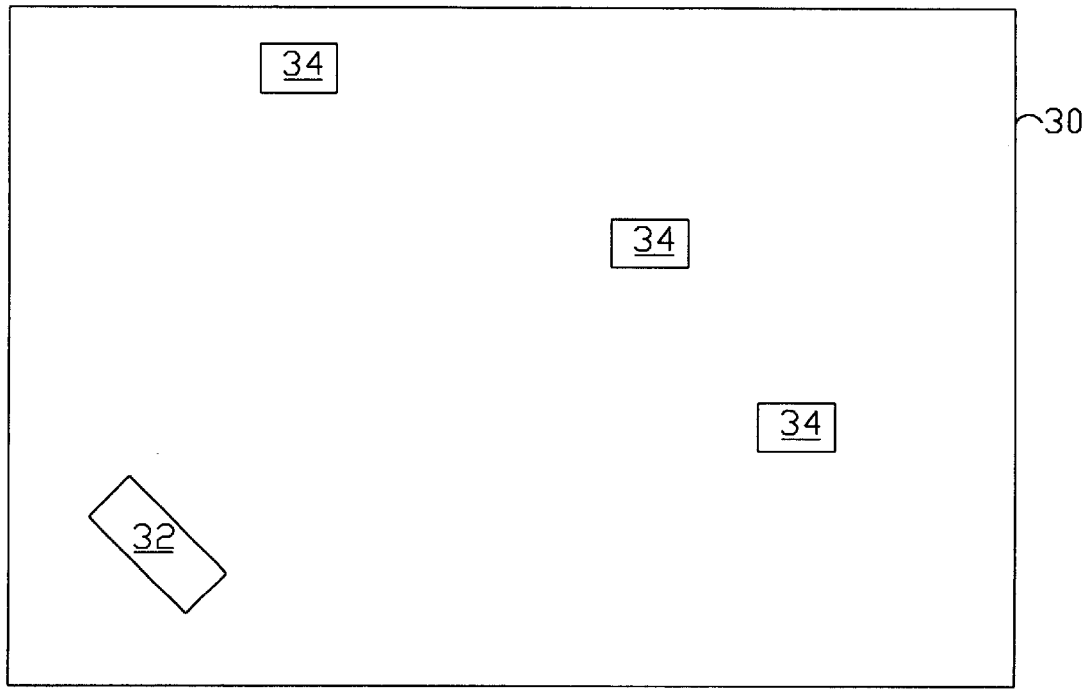

(e) The gas is delivered to the highest temperature portion of the ambient environment while the gas is a cool gas, and the gas is delivered to the lowest temperature portion of the ambient environment while the gas is a warm gas Besides, as shown in FIG. 3A and FIG. 3B, the present intelligent air-condition system 32 can adjust immediately the delivered direction of the gas 31 in according to the motion of the user 33 in the ambient environment 30, such that the user 33 can continually feel the effect of the gas 31 in any time any where (no matter whether the location of objects 34 is fixed or changed). Besides, if there are several users 33 in the ambient environment 30, the intelligent air-condition system 32 can deliver the gas 31 the location of the users 33 in sequence. Further, as shown in FIG. 3C and FIG. 3D, the gas 31 is delivered by the intelligent air-condition system 32 only when at least one user 33 appeared in the ambient environment 30.

What are said above are only the preferred embodiment of the invention and they are not used to limit the claims of the invention; Any changes or modifications that do not depart from the essence displayed by the invention should be limited in what is claimed in the following.

What is claimed is:

1. An intelligent air-condition system, comprising:

infrared radiation detecting means for detecting a temperature distribution of an ambient environment;

analyzing and controlling means for analyzing a plurality of data acquired by said infrared radiation detecting means and producing a plurality of controlling signals for adjusting the temperature of said ambient environment;

gas means for delivering a gas into said ambient environment by a specific way to change said temperature distribution of said ambient environment in accordance with said controlling signals; and power means for providing a power required by the operation of said gas means, wherein said power means having a first motor for driving said gas means and a second motor for driving said infrared radiation detecting means.

2. The system of claim 1, said plurality of controlling signals being used to control said gas means such that said gas is directly deliver into a portion of said ambient environment, wherein at least one human-body temperature signal detected by said infrared radiation detecting means is located at said portion.

3. The system of claim 1, said plurality of controlling signals being used to control said gas means such that the operation of said gas means is paused while no human-body temperature signal located in said ambient environment is detected by said infrared radiation detecting means.

4. The system of claim 1, said plurality of controlling signals being used to control said gas means such that said gas is continually delivered to the location of at least one human-temperature signal in time while said human-temperature signals detected by said infrared radiation detecting means are in motion.

5. The system of claim 1, said plurality of controlling signals being used to control said gas means such that said gas is directly delivered to the highest-temperature portion of said ambient environment while said gas is a cool gas, moreover, said controlling signals being used to control said gas means such that said gas is directly delivered to the lowest-temperature portion of said ambient environment while said gas is a warm gas.

6. The system of claim 1, said infrared radiation detecting means has an infrared radiation sensor and an infrared radiation lens.

7. The system of claim 6, said infrared radiation sensor being chosen from the group consisting of the following: an infrared radiation point sensor, an infrared radiation array sensor, and an infrared radiation sphere sensor.

8. The system of claim 6, said infrared radiation lens being chosen from the group consisting of the following: a spherical lens array and a semi-circle-cylinder lens array.

9. The system of claim 1, wherein the scanning angle of said infrared radiation detecting means is between zero-degree to 360-degrees.

10. The system of claim 1, wherein said analyzing and controlling means has a receiving module, a signal processing module, a memory module and a calculating module.

11. The system of claim 10, said receiving means being used to receive said data detected by said infrared radiation detecting means, said signal processing means being used to process a plurality of signals produced by said receiving means, moreover, both said memory means and said calculating means being used to produce said controlling signals in according to said signals.

12. The system of claim 1, wherein said analyzing and controlling means having an interface module is used to receive at least a controlling command and to deliver at least said controlling commands to said calculating module.

13. The system of claim 12, wherein said interface module receiving at least said controlling commands and transmitting at least said controlling command to said calculating module.

14. The system of claim 1, wherein said gas means having a gas delivering means which is used to adjust the delivering direction of said gas.

15. The system of claim 14, wherein said gas means having a gas producing means which is used to produce gas.

16. The system of claim 15, said gas being chosen from the group consisting of the following: warm gas, cool gas and room temperature gas.

17. The system of claim 14, said gas delivering means being chosen from the group consisting of the following: fan and guiding plate.

18. The system of claim 15, said gas producing means being chosen from the group consisting of the following: an air compressor, a refrigerant and a heating coil.

19. The system of claim 1, wherein said power means has a motor for driving said gas means and said infrared radiation detecting means simultaneously.

* * * * *